United States Patent [19]

Ueno et al.

[11] Patent Number: 4,799,534

[45] Date of Patent: Jan. 24, 1989

[54] VERTICAL DIE CASTING MACHINE

[75] Inventors: Toyoaki Ueno; Sadayuki Dannoura; Masashi Uchida, all of Ube, Japan

[73] Assignee: UBE Industries, Ltd., Yamaguchi, Japan

[21] Appl. No.: 20,390

[22] Filed: Mar. 2, 1987

[30] Foreign Application Priority Data

Mar. 3, 1986 [JP] Japan ..... 61-44185
Mar. 3, 1986 [JP] Japan ..... 61-44186

[51] Int. Cl.[4] ..... B22D 17/12

[52] U.S. Cl. ..... 164/314; 164/312; 425/289; 425/562

[58] Field of Search ..... 164/312, 314, 264; 425/562, 564, 566, 594, 289, 310

[56] References Cited

U.S. PATENT DOCUMENTS

| | | | |
|---|---|---|---|
| 3,969,055 | 7/1976 | Buckethal | 425/573 X |
| 4,077,760 | 3/1978 | Sauer | 425/562 |
| 4,088,178 | 5/1978 | Ueno et al. | 164/312 X |
| 4,284,124 | 8/1981 | Komatsu et al. | 164/314 |
| 4,287,935 | 9/1981 | Ueno et al. | 164/312 X |

FOREIGN PATENT DOCUMENTS

| | | |
|---|---|---|
| 3100463 | 1/1982 | Fed. Rep. of Germany . |
| 55-42116 | 3/1980 | Japan . |
| 56-5621 | 2/1981 | Japan . |

*Primary Examiner*—Nicholas P. Godici
*Assistant Examiner*—J. Reed Batten, Jr.
*Attorney, Agent, or Firm*—Finnegan, Henderson, Farabow, Garrett & Dunner

[57] ABSTRACT

A vertical die casting machine of a vertically clamping type provided with a hydraulic piston-cylinder to actuate movable parting plates disposed between an injection sleeve and a runner hole in a stationary mold for constricting a melt passage, the parting plates defining an axial through-hole in a clamped state. The parting plates prevent a semi-solidified part of the melt "shell" formed in the sleeve before an injection operation from intruding into a die cavity with the liquid melt. In an embodiment with a narrow runner hole having a diameter smaller than that of the sleeve, the parting plates move together to shear a cold melt runner from the cold melt bisket formed in the sleeve so that a cast product may be upwardly removed from the stationary mold. In another embodiment with an enlarged runner hole having a diameter not less than that of the sleeve, the parting plates move away from each other to allow an integral piece including the bisket formed in the sleeve, the runner formed in the runner hole, and the cast product, to be removed upward through the stationary mold and the enlarged runner hole.

29 Claims, 7 Drawing Sheets

VERTICAL DIE CASTING MACHINE

BACKGROUND OF THE INVENTION

1. Field of the Invention

The present invention relates to a vertical die casting machine, i.e., a so called "Vertical Squeeze Casting machine", in which machine a molten metal or melt in a casting sleeve is injected by actuating an injection plunger into a cavity defined by a mold arrangement of a vertically clamping type including lower stationary and upper movable molds through a runner hole formed in the stationary mold, and the melt is poured into the casting sleeve while the sleeve is spaced apart from the stationary mold.

2. Description of the Related Art

Machines such as the above are disclosed in U.S. Pat. No. 4,088,178 and U.S. Pat. No. 4,287,935, having two of the three inventors named in the present invention. Such known machines of the vertically clamping type have the following inherent problems:

The casting or injection sleeve for use in the vertical die casting machine has a hollow head portion defining, with the head of the plunger therein, a melt space where the melt is received. The sleeve head portion has the same diameter over the length thereof and is not constricted at the free end thereof, which end abuts against the stationary mold from below. A melt passage from the surface of the melt received in the sleeve to the cavity is formed to include an enlarged runner hole. The injection of the melt for producing a cast product in the cavity is carried out in two stage operations. At the initial injection stage, the plunger is forced to move at a relatively high speed so that the melt is filled in the cavity. As the final injection stage, the plunger is actuated to move upward at a relatively low speed with an additional short stroke to have the melt filled in the cavity subjected to an increased pressure by the plunger. When the melt is injected into the cavity through the melt passage and then cooled, the solidified melt or cold melt forms, in an integral body, a cast product in the cavity, a melt part, i.e., "runner", in the runner hole, and the remaining melt part, i.e., "bisket", in the upper end portion of the sleeve. The enlarged runner hole is required to allow the bisket to pass through the runner hole so that the entire solidified melt is removed from the stationary mold when the upper movable mold is moved upward and separated from the lower stationary mold. In this regard, the diameter of the runner hole must be not less than that of the sleeve head.

One of the problems resides in that such enlarged runner hole occupies a substantial area of the lower surface of the cavity on the side of the lower stationary mold, since the runner hole opens to the lower surface. This occupation restricts a degree of freedom in designing contoured decorations to be formed at the lower surface of a cast product integrated with the melt runner.

The other problem resides in that such an enlarged runner hole causes the quality of a cast product to be reduced, for the following reason. After the hot melt is poured in the melt space in the sleeve, the received melt is partially cooled at the circumferential inner surface of the sleeve and the surface of the plunger tip to form a semi-solidified part of the melt along the circumferential surface before the injection, i.e., a "shell" of a cylindrical vessel shape. When the melt is injected into the cavity, the shell is broken into pieces and a substantial amount of the shell is forced to enter the cavity, accompanying the remaining hot melt part.

In order to avoid this intrusion of the shell, it has been attempted to provide the stationary mold with a detachable metal net covering the entire cross sectional area of the runner hole therein, as disclosed in Japanese Unexamined Patent Publication (KOKAI) No. 55-42116. Alternatively, in another prior art, the upper end portion of the injection sleeve is provided with a ring detachably mounted therein, as shown in Japanese Examined Patent Publication (KOKOKU) No 56-5621. However, it is noted that these prior art solutions cause difficulties in manual handling of the net or the ring at each injection cycle. Further it is recognized that such means are likely to cause the production of a cast product to require an increased amount of the melt to be wasted as a non-product material.

SUMMARY OF THE INVENTION

It is an object of the present invention to provide an improved vertical die casting machine of a vertically clamping type by which the above mentioned problems are overcome or solved in practice.

According to the present invention, there is provided a vertical die casting machine of a vertically clamping type, comprising: lower stationary and upper movable platens, a mold arrangement clamped between the platens to define a die cavity, a casting sleeve, a plunger slidably disposed in the casting sleeve, and a hydraulic piston-cylinder having the sleeve mounted at the lower end thereof for actuating the plunger. The plunger has a plunger tip at the upper end thereof. The tip together with the sleeve defines a melt space wherein a melt is received for an upward injection of the melt by the plunger into the cavity through a melt passage. The melt passage is freely defined between the cavity and the surface of the melt received in the melt space. The piston-cylinder, for example, is pivotably mounted to the stationary platen so that the sleeve can be tilted for receiving the melt. The machine includes means for constricting the melt passage. The constricting means comprises at least two movable flat parting plates disposed between the sleeve and the lower stationary mold. Each of the parting plates has a groove forming a semi-circle at the parting face thereof. When the melt is injected, the parting plates are clamped to define a vertically extending through-hole formed by the semi-circular grooves. The through-hole is preferably coaxial with the sleeve and has a cross sectional area at the upper end thereof smaller than that at the upper end of the sleeve. The upper end of the sleeve abuts against the parting plates from below during the injection operation, and the parting plates are allowed to move along a first line on a horizontal plane. The constricting means further comprises a first pair of hydraulic piston-cylinders for actuating the parting plates horizontally along the first line.

Preferably, a means is provided for preventing the parting plates, when clamped, from being forced to move horizontally along a second line perpendicular to the first line by a force caused by an injection of the melt. The preventing means comprises a pair of hydraulic or air piston cylinders for actuating opposing piston rods extending along the second line. The piston rods may have flat free end surfaces parallel to the first line. Alternatively, the piston rods may have free end surfaces in a zig-zag fashion to be engagable with the corresponding surface parts of the parting plates.

The parting plates preferably have a converse T-shaped rectangular form, and in the clamped state, are made symmetrical about the first and second lines in such a manner that each parting plate has a flat parting face along the second line where the semi-circular groove is formed. The parting plates further have flat side faces parallel to the first line.

One of the piston rods in the preventing means urges the clamped parting plates at the side faces thereof on one side against the other piston rod at the other side faces of the parting plates along the second line during the injection operation.

Alternatively, one of the pair of the piston cylinders in the preventing means may be replaced by a support which abuts against the parting plates at one side flat faces thereof.

According to one embodiment of the present invention, the machine of a vertically clamping type is incorporated with a mold arrangement having a narrow runner hole forming a part of the melt passage in the stationary mold, the diameter of the hole at the lower end thereof being smaller than that of the sleeve at the upper end thereof, the first pair of piston cylinders in the constricting means are provided for driving the parting plates to move in a direction along the first line together in a clamped state against a melt solidified in the melt passage, to thereby shear the melt solidified after completion of the injection into two pieces at the through-hole of the clamped parting plates. Preferably, the diameter of the narrow runner hole at the lower end thereof may be smaller than that of the through-hole at the upper end thereof. The injection plunger is preferably provided with a hydraulic supplemental piston-cylinder therein for axially actuating a supplemental piston rod. The plunger is actuated during the injection operation at the initial stage thereof so that the hot melt is filled in the cavity. The supplemental piston rod is actuated during the injection operation at the final stage thereof so that the filled melt is subjected to an increased pressure. The supplemental piston rod has an upper rod tip having a diameter smaller than that of the plunger tip and coaxial with the, through-hole defined by the clamped parting plates, and the rod tip preferably has a diameter smaller than that of the through-hole at the upper end thereof.

Alternatively, according to another embodiment the present invention, the machine may be incorporated with a mold arrangement having an enlarged runner hole forming a part of the melt passage in the stationary mold, the diameter of the hole being not less than that of the sleeve at the upper end thereof as that in the conventional machine. The first pair of piston-cylinders, however, is provided for driving the parting plates to move in opposite directions to separate the parting plates from each other, to thereby allow a solidified melt as a whole in the cavity and the melt passage to be upwardly removed from the stationary mold through the separated parting plates after the final injection stage.

The injection piston-cylinder is provided for actuating the plunger to move upward at the initial stage of the injection operation. The parting plates are clamped to constrict the melt passage to define the through-hole at the initial and final injection stages, nd are separated from each other after the final injection stage. Of course, the plunger may be used to carry out the final stage injection. To attain more complete injection, preferably, a supplemental piston-cylinder is provided in the plunger for carrying out the injection at the final stage thereof.

DESCRIPTION OF THE PREFERRED EMBODIMENTS

Figure 1:
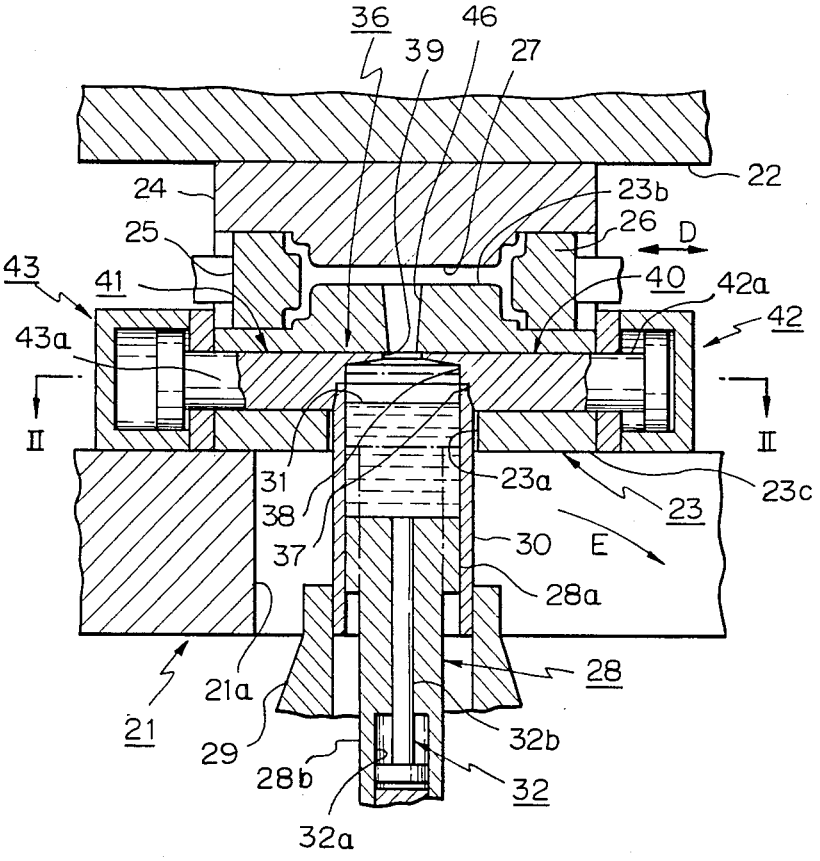
FIG. 1 is a sectional view illustrating a first embodiment of a vertical die casting machine incorporated with a mold arrangement having a narrow runner hole therein, according to the present invention, the machine featuring means for constricting a melt passage during the injection operation and shearing the melt solidified in the melt passage after the injection is completed.
Figure 2:
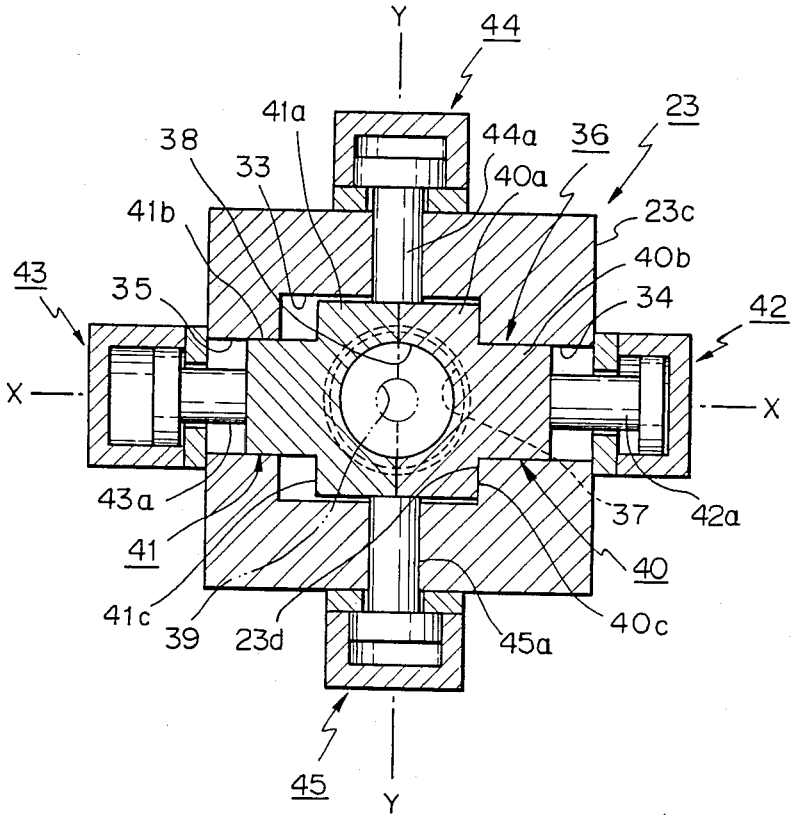
FIG. 2 is a cross sectional view of the machine shown in FIG. 1 taken along the line II—II.
Figure 3A:
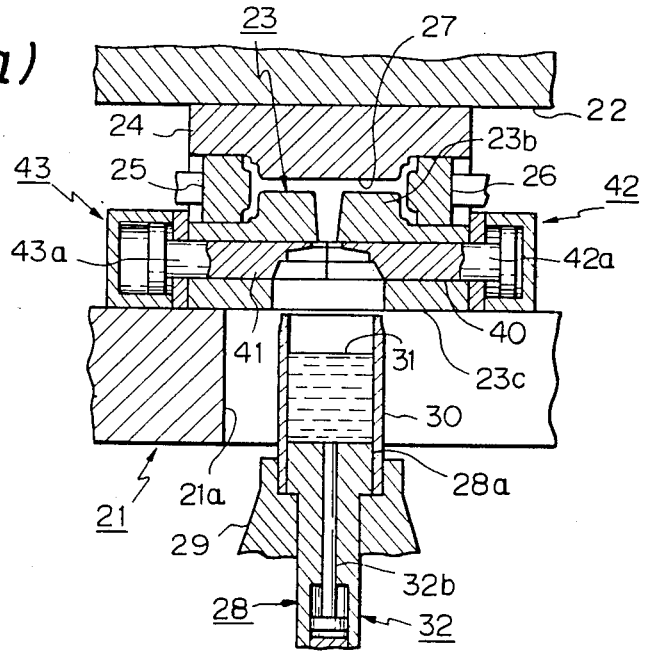
FIGS. 3(*a*) to 3(*f*) are sectional views of the main portions of the first embodiment of the machine illustrating the operations of the machine at various stages.
Figure 3B:
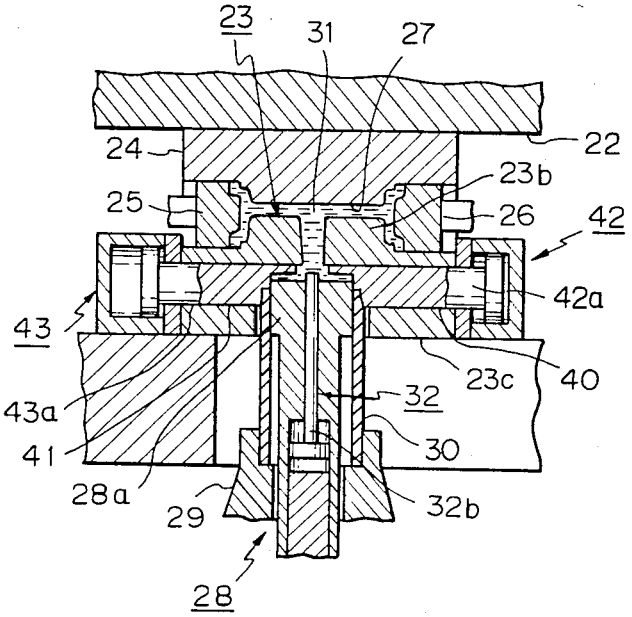
Figure 3C:
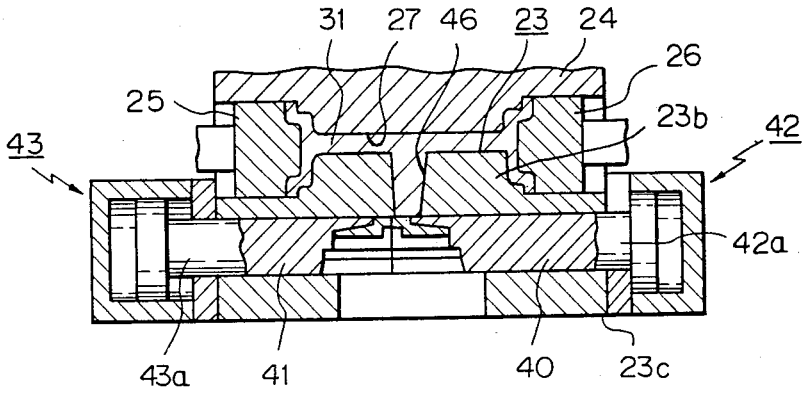
Figure 3D:
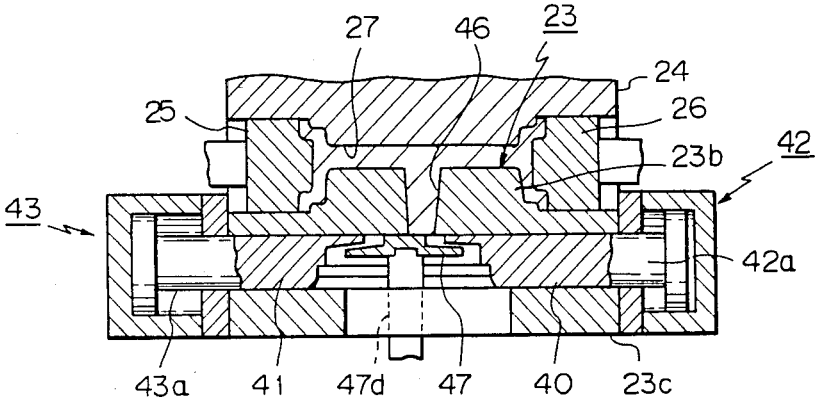
Figure 3E:
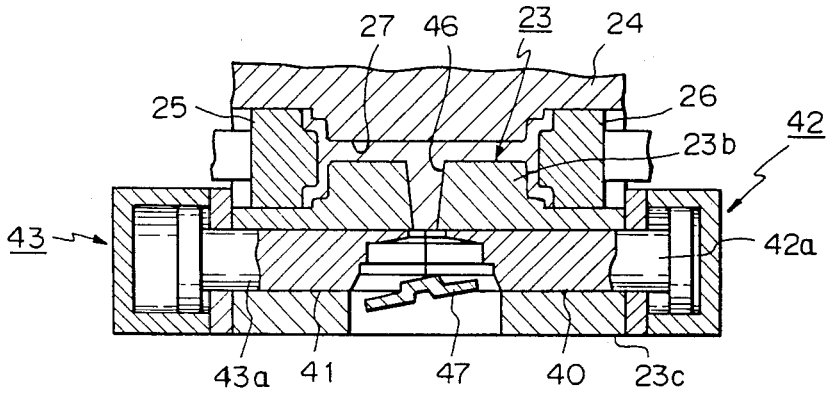
Figure 3F:
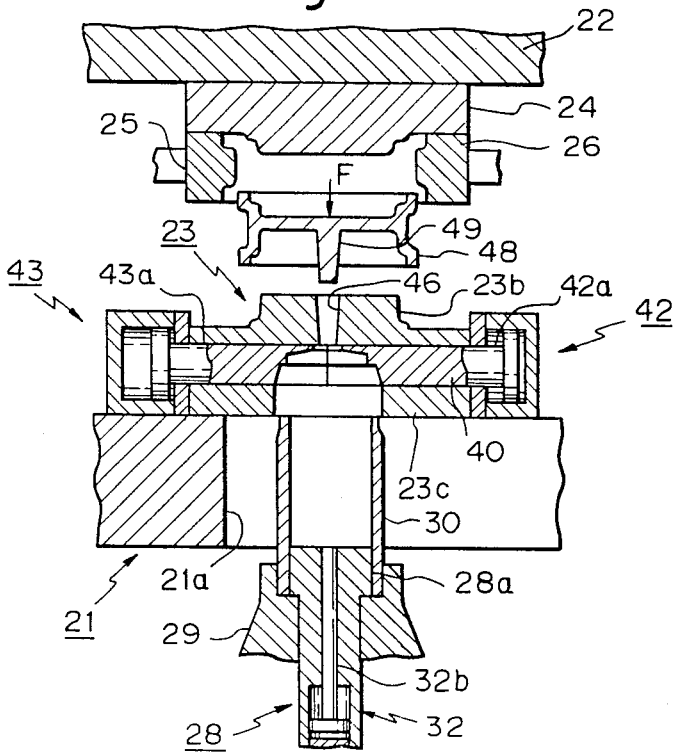

Referring to FIGS. 1 to 3, a vertical die casting machine comprises a stationary platen 21 fixed on a machine base (not shown) and a movable platen 22 movable upward or downward along four tie rods extending vertically from the base at the four corners thereof. A lower stationary mold 23 and a upper movable mold 24 are mounted on the stationary and movable platens 21 and 22, respectively. A clamping piston-cylinder (not shown) is provided over the movable platen 22 for actuating the movable platen to move upwards or downward, so that the movable mold 24 is clamped or unclamped relative to the stationary mold 23. Between the stationary and movable molds, a pair of laterally movable molds 25 and 26 forming "cores" are disposed while supported on the side of the movable mold 24. The cores 25 and 26 are actuated by a driving device (not shown) to move forward or backward in a horizontal direction D. A mold arrangement of the present embodiment consists of the stationary mold 23, the movable mold 24, and the pair of cores 25 and 26, for use in casting an aluminium wheel of a motor car. The mold arrangement, when clamped, is designed to define a die cavity 27, which forms a space in the mold arrangement having the same configuration as that of the aluminium wheel.

A hydraulic injection piston-cylinder (not shown) is pivotably mounted on the machine base so that it can be tilted from a vertical position. A block 29 is provided on the side of the injection piston-cylinder and is actuated by another piston-cylinder (not shown). A casting or injection sleeve 30, having a plunger 28 movably disposed therein, is axially mounted on the block 29 at the upper end thereof. The casting sleeve 30 is movable with the block 29, and the head portion of the sleeve can be received and fitted in a sleeve hole 23*a* formed in the stationary mold 23, when the block 29 is actuated to move upward. The stationary platen 21 has a notch 21*a* at which the sleeve 30 and the block 29 are disposed. The block 29 is forced to move downward to remove the sleeve from the sleeve hole 23*a*, and then the sleeve is forced to be tilted with the injection piston-cylinder in a direction E for receiving a melt or molten metal 31 in a melt space defined between the tip 28*a* of the plunger 28 and the sleeve 30. After the melt is poured into the melt space, the sleeve 30 is raised vertically and then is moved upward to fit in the sleeve hole 23*a*. In the arrangement, the melt is extruded into the cavity by the plunger head 28*a* through a melt passage defined between the surface of the melt received in the sleeve and the cavity.

The above melt extrusion by the plunger 28 forms an initial stage of the injection or casting operation. A hydraulic supplemental piston-cylinder 32, comprising a cylinder 32*a* formed in the plunger 28 at a rod 28*b* thereof and a piston rod 32*b* axially extending through an axial hole formed in the rod 28*b*, is provided for actuating the piston rod 32*b* to pressurize the melt in the cavity against the clamped molds at a final stage of the injection operation.

The stationary mold 23 consists of an upper plate 23*b* and a lower plate 23*c* connected by means of bolts.

The upper plate 23*b* has a narrow runner hole 46 communicating with the cavity. The lower plate 23*c* has a through-hole extending vertically and forming a central hole portion 33 (FIG. 2) having a rectangular shape and a pair of narrow guiding hole portions 34 and 35 extending horizontally in opposite directions from the central hole portion 33 along a first line X. The through-hole forms a hollow space defined by the upper plate 23*b* and the lower plate 23*c*.

A gate plate arrangement 36 is provided so as to slidably move along the first line in the hollow space of the lower plate 23*c*, and consists of a pair of parting plates 40 and 41 having opposite parting faces. The parting faces are located, in a combined or clamped state of the plates, along a second line perpendicular to the first line. The first and second lines lie on a horizontal plane. The parting plates 40 and 41 are designed so as to be converse T-shaped rectangular flat forms symmetrical to the first and second lines. The parting plates 40 and 41 have grooves forming a semicircle at the parting faces thereof, respectively, and define an axial through-hole formed by the semi-circular grooves in the clamped state. The axial through-hole is coaxial with the casting sleeve 30 and the sleeve hole 23*a*. The axial through-hole formed by the pair of the parting plates 40 and 41 has a lower enlarged portion 38 and an upper constricted portion 39.

The T-shaped parting plates 40 and 41 have enlarged gating portions 40*a* and 41*a* slidable in the central hole portion 33 and constricted guiding portions 40*b* and 41*b* slidable in the narrow guiding hole portions 34 and 35.

A tolerance of the gating portions 40*a* and 41*a* in the central hole portion 33 on each side thereof is designed to be about 0.5 mm, while another tolerance of the parting plates 40 and 41 in the guiding portions 40*b* and 41*b* is designed to be over 0.1 mm.

A pair of hydraulic piston cylinders 42 and 43 are conversely mounted to the lower plate 23*c* of the stationary mold 23 for actuating piston rods 42*a* and 43*a*, which are connected to the parting plates 40 and 41 at the ends of the guiding portions 40*b* and 41*b*, respectively. In this embodiment, a piston stroke of the piston-cylinder 42 on the right side is set to about 15 mm from the position as shown in the figure to the left, and a piston stroke of the piston-cylinder 43 on the left side is set to about 30 mm from the position as shown in the figure to the left. In connection with the stroke designs, the central hole portion 33 has a length along the first line X larger than that of the gating plate portions 40*a* and 41*a* in the clamped state by over 15 mm, so that the gating plate arrangement in the clamped state is allowed to move along the first line X by the stroke gap, i.e., 15 mm. The second line Y is biased to the right by 15 mm from the center line of the central hole portion 33 parallel to the second line.

When the melt is injected to the cavity 27, the left piston-cylinder 43 actuates the parting plates 40 and 41 to move to the right and thus urge the plates against the lower mold plate 23*c* at a shoulder 23*d* thereof. In this urged state, a shoulder 40*c* of the plate 40 abuts against the shoulder 23*d*, and the plates 40 and 41 are clamped with the through-hole having the hole portions 38 and 39 coaxial with the sleeve 30. Such clamping and positioning can be alternatively effected by driving both the piston-cylinders 42 and 43 simultaneously in opposing directions. Compared with this alternative positioning method, the former positioning method as embodied by using the shoulders 23*d* and 40*c* is more advantageous in that the position can be more assuredly and easily adjusted as required.

The right piston-cylinder 42 is driven to actuate the clamped parting plates to move to the left by 15 mm. By this movement, the melt solidified in the melt passage is sheared at the upper end of the through-hole formed in the clamped parting plates. The melt passage includes the end portion of the sleeve 30, the through-hole (38, 39) of the parting plates, and the runner hole 46. Alternatively, this movement can be effected by driving both the piston-cylinders 42 and 43 simultaneously in a direction toward the left side.

A pair of hydraulic piston-cylinders 44 and 45 are conversely mounted to the stationary mold 23 for actuating piston rods 44*a* and 45*a*. The lower plate 23*c* of the stationary mold 23 has holes along the second line Y wherein the piston rods 44*a* and 45*a* are slidably disposed. Both of the piston-cylinders 44 and 45 are driven to actuate the piston rods so that the flat end of one of the piston rods 44*a* urges the clamped parting plates 40 and 41 at the flat side faces on one side of both the plates against the flat end of the other piston rod 45*a* at the flat side faces on the other side of the plates. During the movement of the parting plates 40 and 41, the piston rods 44*a* and 45*a* are withdrawn and spaced apart from the parting plates.

The upper hole portion 39 of the clamped parting plates 40 and 41 has a diameter larger than that of the runner hole 46, and larger than that of the piston rod 32*b* of the supplemental piston-cylinder 32, but smaller than that of the head of the sleeve 30.

With the above arrangement, the vertical die casting machine is operated as follows, with reference to FIGS. 3(*a*) to 3(*f*).

Referring to FIG. 3(*a*), the injection sleeve 30 is in a lower position with the block 29, where the plunger 28 is in the lower position relative to the sleeve. A predetermined amount of the melt 31 is contained in the melt space of the sleeve defined by the sleeve and the plunger, subsequent to the tilting of the sleeve for receiving the melt. The piston rod 42*a* is in a retracted position, while the piston rod 43*a* is in a forward position, so that the shoulder 40*c* of the parting plate 40 abuts against the shoulder 23*d* of the lower stationary mold plate 23*c*. The piston rods 44*a* and 45*a* are in forward positions and urge the parting plates 42 and 43 against each other.

In the above state, the block 29 is forced to rise so that the sleeve 30 is engaged with the sleeve hole 23*a* and the enlarged hole portions 37 and 38 of the clamped parting plates 40 and 41 and abuts against the clamped parting plates 40 and 41. Thereafter, the injection cylinder is driven to actuate the plunger 28 to inject the melt 31 into the cavity through the melt passage. At the final stage of the injection operation, the supplemental cylinder 32 is driven to actuate the piston rod 32*b* so that the rod 32*b* extends upward from the plunger tip 28*a*, thus completing the final injection of the melt, that is, pressurizing the melt against the clamped molds.

After the melt is received in the melt space, a shell of the melt is formed at the inner surface of the melt space. This shell is prevented from rising by the circumferential edge of the constricted hole portion 39 of the clamped plates 40 and 41 and is compressed, with the result that the shell is deformed into the shape of a bellows fashion and does not enter the cavity.

During the injection as shown in FIG. 3 (*b*), the melt causes the parting plates 40 and 41 to be thermally expanded due to the high thermal energy thereof, and thus the melt injection causes the clamped parting plates 40 and 41 to be subjected to a high pressure such as 1000 $kg/cm^2$ at the through-hole (37, 38, 39), thus forcing the clamped parting plates apart from each other. Such a parting phenomenon as above is prevented by the pressure exerted on the parting plates by the opposite piston rods 44*a* and 45*a* along the second line Y in cooperation with the clamping of the parting plates in the direction X. In connection with this prevention, the gating plate portions 40*a* and 41*a* are prevented from seizure with the guiding central hole portion 33 to be pressurized against the gating plate portions, and thus the slidability of the plates 40 and 41 in the central hole portion 33 is ensured. Further, parting of the clamped plates from each other at the through-hole (37, 38, 39) due to deformation of the plates is prevented. Still further, the shearing operation with the parting plates 40 and 41 is not affected, and entrance of some part of the solidified melt forming "flashes" between the clamped parting faces is prevented.

Referring to FIG. 3(*c*), after the melt in the cavity is solidified, the injection sleeve 30 is moved downward, and then the piston rods 44*a* and 45*a* are retracted and release the parting plates from the clamping pressure. At this stage, the right piston rod 42*a* is forced to move forward by about 15 mm, and concurrently, the left piston rod 43*a* is retracted by the same stroke, so that the solidified melt is sheared at a position between the lower end of the runner hole 46 and the constricted hole portion 39 of he clamped parting plates 40 and 41 as shown in FIG. 3(*c*). In this shearing operation, the parting plates 40 and 41 are released from the pressure exerted by the piston rods 44*a* and 45*a* and thus a smooth shearing operation is attained.

Prior to opening of the molds, the piston rod 42*a* moved back by a stroke of 15 mm, that is, to the retracted position shown in FIG. 3(*d*). Concurrently, the opposing piston rod 43*a* is forced to move back in the opposite direction by a stroke of 15 mm, as shown in FIG. 3(*d*). As a result, the parting plates 40 and 41 are allowed to part by 30 mm, as shown in FIG. 3(*d*). By this parting operation a bisket 47, a lower portion of the solidified melt sheared off from the runner of the solidified melt, is removable from the parting plates 40 and 41, so that the bisket 47 can drop out of the stationary mold 23, as shown in FIG. 3.

In such a removing operation as above, preferably a supporting rod 47*d*, as shown by phantom lines in FIG. 3(*d*), supports the bisket 47 from below, when the parting plates 40 and 41 are forced to move in opposite directions. This supporting means prevents the bisket 47 from accompanying the moving parting plates, and thus removal of the bisket 47 from the parting plates is assured even if adhesion of the bisket with the parting plates is high.

FIG. 3(*e*) shows the bisket 47 dropping out of the mold 23. After the removal of the bisket 47, the parting plate 40 is forced by the piston rod 43*a* to return to the forward position by the maximum stroke of 30 mm for a subsequent injection, while the other parting plate 41 remains in the retracted position at which the shoulder 41*c* of the plate 41 abuts against the lower plate 23*c* of the stationary mold 23 at the shoulders 23*d* and 40*c* thereof, as shown in FIG. 2 and FIG. 3(*e*).

Thereafter, as shown in FIG. 3(*f*), the movable platen 22 is raised to part the molds 23 and 24 from each other, while a cast product 48 is held by the movable mold 24 and the cores 25 and 26. The cores 25 and 26 are then removed from the product 48, and the product is removed from the movable mold 24 in the direction shown by arrow F by projecting ejector pins provided in the movable mold (not shown) moving from the inner surface thereof against the product.

The removed product is transferred out of the system by a product remove apparatus (not shown) having an arm for carrying the product.

One cycle of the injection is completed after the operation of removing the product and the mold clamping operation.

The obtained product has a runner 49, which is cut off by using a lathe having a cutting tool. Alternatively, the runner 49 is notched and then broken away from the product 48 at the notch by, for example, a punch.

The above embodiment of the present invention is directed to a vertical clamping and vertical casting type machine of a single unit. In practice, however, it is preferable to apply the present invention for a rotary type die casting machine having a rotary table provided with a plurality of mold clamping units, each including a mold arrangement having molds such as the above mentioned molds 23, 24, 25 and 26, which mold clamping units are arranged at respective equiangular positions along a periphery of the rotary table. Separate stations provided with a unit for die casting, a unit for removing a cast product, and a unit for mold spraying are also arranged along the periphery of the rotary table. The mold clamping units are forced to move around the stations intermittently so that each station unit cooperates with the mold clamping unit at that station, to thereby carry out die casting, shearing the bisket 47, taking out a cast product, mold-spraying, and other operations necessary to carry out one cycle during one rotation of the rotary table.

Figure 4:
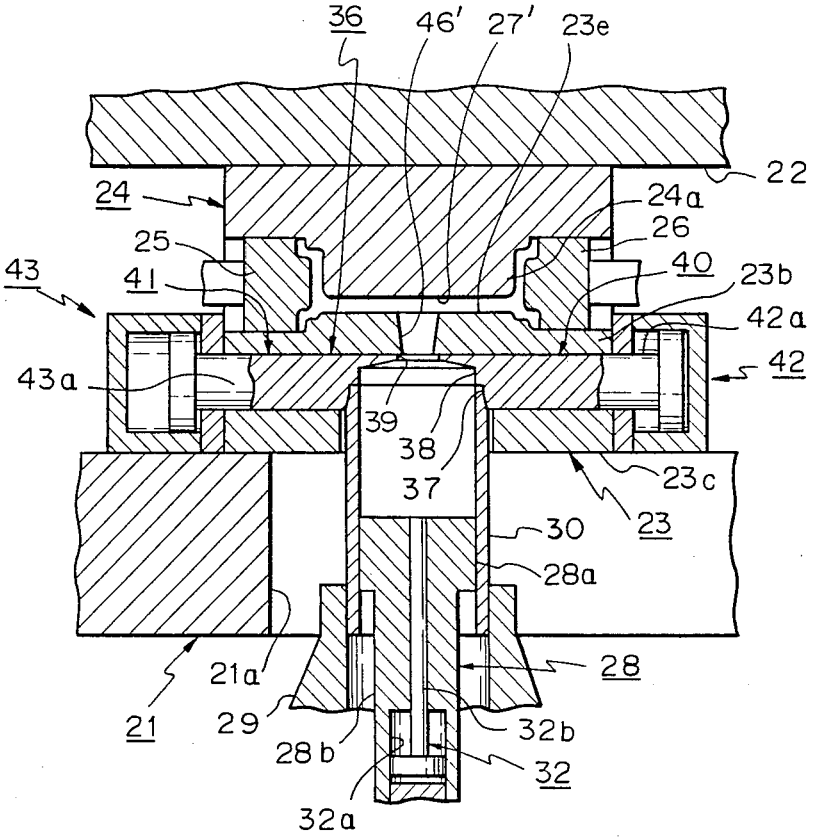
FIG. 4 is a sectional view corresponding to FIG. 1, illustrating a second embodiment of the vertical die casting machine according to the present invention, featuring a mold arrangement having a narrow runner hole therein and defining a cavity having a configuration designed to be the reverse of that of the mold arrangement shown in FIG. 1.

Another embodiment of the present invention, directed to a vertical die casting machine, is shown in FIG. 4, wherein members or elements of this machine corresponding to those of the above-mentioned machine as shown in FIGS. 1 to 3 are denoted by the same reference numerals, respectively.

In comparison with the first embodied machine, this second embodied machine has a cavity 27' defined by a stationary mold 23, a movable mold 24, and cores 25 and 26 has a reverse configuration to that of the first machine. That is, a runner hole 46' communicates with the cavity 27' on the lower side thereof 23e, where a decorative surface of an aluminium wheel product is formed in stationary mold 23b. According to the first machine as shown in FIG. 1, such a decorative surface of the wheel product is formed at the upper side of the cavity 27 in movable mold 24, at which the runner hole 46 does not open.

Generally speaking, in the reversed mold arrangement as shown in FIG. 4, a degree of freedom in designing a decorative surface of the wheel product is reduced relative to the other mold arrangement, since a cavity has a decorative surface on the runner hole side and thus the runner hole occupies a substantial area in the decorative surface.

The reversed mold arrangement for the wheel as shown in FIG. 4, however, has an advantage in that the runner hole 46 has a shorter length than that of the first machine shown in FIGS. 1 to 3, and thus the reversed mold arrangement for the wheel product is economical in the light of the fact that the cast runner 49 of aluminium must be removed from the final product.

Further, the shorter runner hole causes the cast product to have a reduced amount of air accompanying the injected melt, resulting in the production of a high quality aluminium wheel.

The parting plates 40 and 41 as shown in FIGS. 1 and 4 must be used for shearing the runner 49. In marked contrast in the following embodiment as shown in FIG. 5, these parting plates are used only for constricting a melt passage through which the melt is injected into a cavity.

Figure 5:
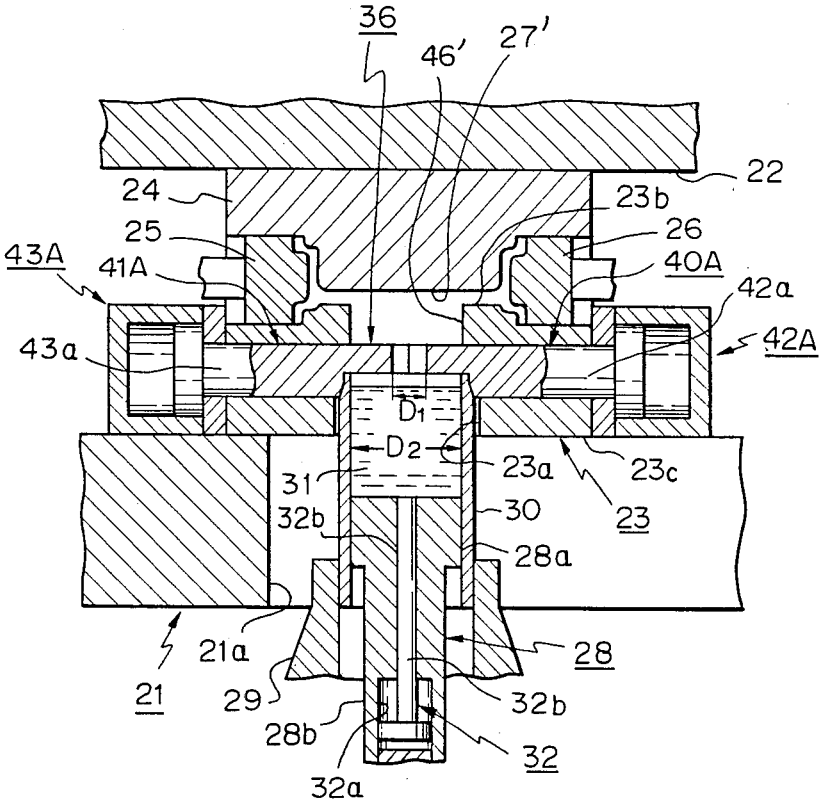
FIG. 5 is a sectional view corresponding to FIG. 1, illustrating a third embodiment of the vertical die casting machine incorporated with a mold arrangement having an enlarged runner hole, according to the present invention, the machine featuring means for constricting a melt passage during the injection operation and for having the constriction released after the injection is completed.

FIG. 5 illustrates an vertical die casting machine of a vertically clamping type incorporated with a mold arrangement having an enlarged runner hole therein having a diameter not less than that of the sleeve, as that used in the conventional machine of the vertically clamping type.

In the figure, the same reference numerals as those of the above-mentioned first and second machines shown in FIGS. 1 to 4 denote substantially the same members or elements of the machines.

Referring to FIG. 5, a parting plate 40A and another parting plate 41A are connected to piston rods 42a and 43a of hydraulic piston-cylinders 42A and 43A, respectively.

The parting plates are forced to move in opposite directions by the cylinders 42A and 43A. The strokes of the piston rods 42a and 43a are larger than in the above-mentioned first (FIGS. 1–3) and second (FIG. 4) machines.

When the parting plates are clamped at the forward positions of the opposite piston rods 42a and 43a, the melt passage is constricted to have a reduced diameter of $D_1$ by the clamped parting plates. When the piston rods are in the respective retracted positions, the diameter of the melt passage defined by the released parting plates is the same as or not less than the internal diameter $D_2$ of the injection sleeve 30.

A pair of hydraulic piston-cylinders 44 and 45 are provided for actuating one of the piston rods 44a and 45a to urge the parting plates against the other piston rod, as in the machine shown in FIG. 2.

A plunger 28 is forced to move upward to inject the melt into the cavity through the constricted melt passage at the initial injection stage. During this injection operation, the shell of the melt formed at the circumferential inner surface of the sleeve 30 is forced to move upward by the plunger tip 28a, but is prevented from entering the cavity 27', communicating a runner hole 46' which has a same diameter not less than that $D_2$ of the sleeve, by the clamped parting plates 40A and 41A.

This causes the shell to be compressed and deformed to a bellows shape.

A supplemental hydraulic piston-cylinder 32 is preferably provided in the sleeve 30, as in the first machine in FIG. 1, for actuating a piston rod 32b in a cylinder 32a to carry out the final stage injection to the effect that the melt filled in the cavity 27' by the initial stage injection is to be subjected to an increased pressure, while the parting plates 40A and 41A are clamped to form the constricted part of the melt passage between the sleeve 30 and the upper plate 23b of the stationary mold 23.

The provision of the supplemental piston-cylinder 32 is preferable for the following reason: The deformed shell of the bellows shape would be likely to prevent the piston rod 28a from moving upward at the end of the final injection stage, so long as the plunger 28 were used as in the conventional machine for carrying out the final stage injection in the machine. In turn, the supplemental piston rod 32b, if provided, is not affected for an upward movement, since the diameter of the rod 28a is smaller than that of the deformed shell, and thus ensures a complete pressurizing operation against the injected melt.

After completion of the two stage injection, the piston rods 44a and 45a are moved back to the retracted positions to release the parting plates 40A and 41A from the clamping state, and then the piston rods 42a and 43a are actuated and moved back to the respective retracted positions, so that the parting plates 40A and 41A are separated.

At this stage, the bisket of the solidified melt below and integrated with the constricted melt runner is allowed to move upward over the removed parting plates. The cast product having the runner and the bisket is then elevated with the movable mold 24 and finally taken out from the machine. The bisket is removed from the cast product by breaking the runner at the part thereof constricted by the clamped parting plates, by using a hammer.

In the above three embodiments, the means for preventing the clamped parting plates 40 or 40A and 41 or 41A from moving along the second line Y is comprised by the pair of piston-cylinders 44 and 45. This means may consist of a stationary stopper on one side, in place of the piston-cylinder 45, and an piston-cylinder on the other side, corresponding to the cylinder 44, so that the single piston-cylinder is driven to urge the parting plates 40 and 41 against the stationary stopper.

With a mold arrangement having an enlarged runner hole as shown in FIG. 5, the injection sleeve may be a combination of separate lower and upper parts, unlike the sleeve having an integral body as shown in FIG. 1. The lower part of the sleeve is mounted on the injection piston-cylinder for actuating the plunger, while the upper part is mounted in the stationary platen. The lower movable part of the sleeve abuts against the upper stationary part from below during the injection operation, to enable communication therebetween.

Preferably, the stationary upper part of the sleeve has a circumferential groove formed at an internal surface thereof at the upper end of the stationary upper sleeve part so as to enlarge the sleeve hollow at the top end thereof. The deformed shell may be received by the circumferential groove during the initial stage of the injection and thus the final stage injection is not affected by the shell.

With respect to the diameter $D_1$ of the through-hole defined by the clamped parting plates relative to that $D_2$ of the sleeve, a difference in the diameter between the through-hole and the sleeve is preferably 5 to 20 mm.

Three or more parting plates may be provided, as long as they are designed so that they can be clamped to define a through-hole having a predetermined diameter.

In summary, the first and second vertical die casting machines as shown in FIG. 1 and FIG. 4 are incorporated with mold arrangements, each defining a cavity having a narrow runner hole 46 with a diameter smaller than that of the injection sleeve 30. The mold arrangement preferably requires the supplemental piston-cylinder 32, and means for shearing a small runner formed in the runner hole 46 to separate a bisket 47 of the solidified melt having the same diameter as that of the sleeve 30 from a cast product formed in the cavity. This is because the bisket, otherwise, prevents the cast product from being removed from the mold arrangement.

The mold arrangement having the narrow runner hole 46 is advantageous in that it allows the cast product to have a large surface area where contoured decorations can be formed by the die casting, so long as a decorative surface of the cavity has such narrow runner hole 46.

Further, the narrow runner hole 46 is advantageous in that it prevents the shell of the melt formed in the sleeve 30 in cooperation with the shearing means comprising the constricting parting plates 40 and 41, from being forced to enter the cavity. Otherwise, the shell is likely to enter the cavity, reducing the quality of the cast product.

Still further, the design of such narrow runner hole is advantageous in saving a substantial amount of the melt solidified in the runner hole, compared with the enlarged runner hole.

With the mold arrangement, as shown in FIG. 5, defining a cavity having an enlarged runner hole 46' having a diameter the same as or not less than that of the sleeve, no problem arises in removing a cast product from the cavity, since a bisket of the solidified melt formed in the sleeve 30 is allowed to pass freely through the runner hole 46, and thus there is no need to separate the bisket from the cast product when the product is taken out of the mold arrangement.

The parting plate means for constricting the melt passage including the head hollow portion of the sleeve 30 and the enlarged runner hole 46' must prevent the shell from intruding into the cavity during the first stage of the injection.

However, the above constricting means is not required to shear the solidified melt runner, unlike the narrow runner hole case, but is required to actuate the pair of the parting plates 40A and 41A so that they are separated, to thereby allow the solidified melt as a whole in the cavity and the melt passage to be upwardly removed from the stationary mold through the separated parting plates. The above function of the constricting means is desirable, because the most rational and economical operation for removing the melt solidified in the melt passage from a final cast product resides in that such removal is carried out after the stationary and movable molds are separated from each other. If the solidified melt runner were sheared, the lower part of the melt, i.e., the "bisket", would remain in the sleeve 30, and thus an additional operation to take out the bisket from the sleeve would be required, or alternatively means or operations for avoiding dropping of the bisket into the sleeve is required.

The present invention is not limited to the above mentioned embodiments directed to die casting machine for producing aluminium wheels for use in motor cars, but can be applied for producing other products not only of metal materials but also of plastic materials. Other embodiments of the invention will be apparent to the skilled in the art from consideration of the specification and practice of the invention disclosed herein. It is intended that the specification and examples be considered as exemplary only, with a true scope and spirit of the invention being indicated by the following claims.

We claim:

1. A vertical die casting machine of a vertically clamping type, comprising:

stationary and movable platens;

a mold arrangement including lower stationary and upper movable molds which are clamped between said platens to define a die cavity;

a casting sleeve;

a plunger slidably disposed in said casting sleeve, said plunger having a plunger tip at the upper end thereof, which tip together with said sleeve defines a melt space wherein a melt is received for an upward injection of the melt by said plunger into said cavity through a melt passage, said melt passage being freely defined between said cavity and the surface of the melt received in said melt space;

an injection hydraulic piston-cylindrical for actuating said plunger therein to selectively inject melt into said die cavity during an injection operation; and means for constricting said melt passage, said constricting means including at least two movable flat parting plates disposed between said sleeve and said stationary mold or in said stationary mold, each of said parting plates having a groove forming a semi-circle at the parting face thereof, said parting plate being clamped when the melt is injected to define a vertically extending through-hole formed by said semi-circular grooves, said through-hole having a cross sectional area at the upper end thereof smaller than that at the upper end of said sleeve, the upper end of said sleeve being in contact with said parting plates from below during the injection operation.

2. A vertical die casting machine according to claim 1, wherein said constricting means further includes a first pair of hydraulic piston-cylinders for actuating said parting plates laterally along a first line within a lateral plane.

3. A vertical die casting machine according to claim 2, wherein said parting plates are movably disposed along said first line, and means is provided for preventing said parting plates, when clamped inward, from being forced to move laterally along a second line within said lateral plane and perpendicular to said first line by a force caused by an injection of said melt.

4. A vertical die casting machine according to claim 3, wherein said preventing means comprises a second pair of piston-cylinders for actuating opposing piston rods extending along said second line, one of said pistons urging said clamped parting plates at the side faces thereof on one side against said other piston at the other side faces of said parting plates along said second line during the injection operation.

5. A vertical die casting machine according to claim 4, wherein said parting plates have converse T-shaped rectangular forms which in the clamped state are made symmetrical about said first and second lines in such a manner that each parting plate has a flat parting face along said second line, where said semicircular groove is formed.

6. A vertical die casting machine according to claims 1, 2, 3, 4 or 5, wherein said first pair of hydraulic piston-cylinders are provided for driving said parting plates to move in a direction along said first line together in a clamped state against a melt solidified in said melt passage, to thereby shear the solidified melt into two pieces at said through-hole during a shearing operation conducted after completion of the injection operation.

7. A vertical die casting machine according to claim 6, wherein said melt passage has a part defined by a runner hole formed in said stationary mold and communicating said cavity with said through-hole defined by said clamped parting plates, said runner hole having a diameter at the lower end thereof not larger than that of said through-hole at the upper end thereof and that of said sleeve.

8. A vertical die casting machine according to claim 7, wherein said plunger is provided with a supplemental piston-cylinder therein for axially actuating a supplemental piston rod having a diameter smaller than that of said plunger tip, said plunger being actuated during the injection operation at the initial stage thereof so that the cavity is filled with the melt and said supplemental piston rod being actuated during the injection operation at the final stage thereof, so that the melt in the cavity is subjected to an increased pressure.

9. A vertical die casting machine according to claim 8, wherein said sleeve is an integral body, and said stationary mold comprises upper and lower mold plates forming a space therebetween, said parting plates being slidably disposed in said space, said lower mold plate having a vertically extending through-hole in which the upper end portion of said sleeve is receivable, said through-hole formed in said clamped parting plates having a lower enlarged portion and an upper constricted portion, the upper end of said sleeve abutting against said clamped parting plates from below in such a manner that said upper end portion of said sleeve is received in said lower enlarged portion during the injection operation, and said sleeve being removed downwards from said clamped parting plates during the shearing operation for the solidified melt.

10. A vertical die casting machine according to claims 1, 2, 3, 4, or 5, wherein said melt passage has a part defined by a runner hole formed in said stationary mold and communicating said cavity with said through-hole defined by said clamped parting plates, said runner hole having a diameter not less than that of said injection sleeve, said first pair of piston-cylinders being provided for driving said parting plates to move in opposite directions to separate said parting plates from each other to thereby allow a solidified melt as a whole in said cavity and said melt passage to be upwardly removed from said stationary mold through said separate parting plates.

11. A vertical die casting machine according to claim 10, wherein said plunger is provided with a supplemental piston-cylinder therein for axially actuating a supplemental piston rod having a diameter smaller than that of said plunger tip, said injection piston-cylinder being provided for carrying out an initial stage injection whereby the cavity is filled with the melt, said supplemental piston-cylinder being driven for carrying out the final stage injection whereby the melt received in the cavity is subjected to an increased pressure, while said parting plates are clamped to form said through-hole constricting said melt passage.

12. A die casting machine comprising:

a stationary platen;

a mold arrangement including lower stationary and upper movable molds which define a die cavity, said stationary mold having a runner hole communicating with said die cavity;

a casting sleeve disposed below said stationary mold, an upper portion of said casting sleeve including a melt space for receiving a melt, said melt space being in communication with said die cavity through a melt passage including said runner hole;

a means for injecting melt from said sleeve through said melt passage and into said die cavity;

means disposed along said melt passage between said casting sleeve and said runner hole for constricting said melt passage during injection of the melt into said die cavity, said constricting means defining a through-hole having a cross sectional area at an upper end thereof that is less than the cross sectional area of said casting sleeve at an upper portion thereof.

13. A die casting machine according to claim 12, wherein the cross sectional area of the runner hole is less than the cross sectional area of the casting sleeve.

14. A die casting machine according to claim 13, wherein said constricting means includes at least two movable opposing plates each having a substantially semi-circular cut-out portion, said cut-out portions defining said through-hole when said plates are clamped together during the injection of the melt into the die cavity.

15. A die casting machine according to claim 14, wherein said constricting means further includes a first pair of hydraulic piston-cylinders for selectively actuating said opposing plates laterally toward and away from each other along a first line in a plane including a cross sectional area of said melt passage, said first pair of hydraulic piston-cylinders moving said opposing plates together during injection of the melt for defining said through-hole.

16. A die casting machine according to claim 15, wherein said constructing means further includes means for preventing said plates from moving apart during injection of the melt, said preventing means transmitting a force to said plates along a second line perpendicular to said first line in said cross sectional plane.

17. A die casting machine according to claim 16, wherein said preventing means includes a second pair of hydraulic piston-cylinders for actuating opposing piston rods disposed along said second line and moving said second pair of hydraulic cylinders into contact with side portions of said opposing plates during injection of the melt.

18. A die casting machine according to claim 17, further comprising means for laterally moving said opposing plates relative to said stationary mold after the melt has solidified to thereby shear the solidifed melt into two pieces at said through-hole after completion of the injection.

19. A die casting machine according to claim 18, wherein the cross sectional area of the runner hole at a lower portion thereof is less than the cross sectional area of an upper portion of the through-hole formed when said plates are clamped.

20. A die casting machine according to claim 12, wherein said injecting means includes a first plunger slidable with said casting sleeve and means for selectively moving said plunger toward and away from said stationary mold.

21. A die casting machine according to claim 20, wherein said injecting means further includes a second plunger slidably received within said first plunger and means for selectively moving said second plunger toward and away from said stationary mold, said second plunger being smaller in diameter than said first plunger.

22. A die casting machine according to claim 21, wherein said second plunger is sized to slide within said through-hole defined by said constricting means.

23. A die casting machine according to claim 12, wherein the cross sectional area of the runner hole is greater than or equal to the cross sectional area of the casting sleeve.

24. A die casting machine according to claim 23, wherein said constricting means includes at least two movable opposing plates each having a substantially semi-circular cut-out portion, said cut-out portions defining said through-hole when said plates are clamped together during the injection of the melt into the die cavity.

25. A die casting machine according to claim 24, wherein said constricting means further includes a first pair of hydraulic piston-cylinders for actuating said opposing plates laterally toward and away from search other along a first line in a plane including a cross sectional area of said melt passage, said first pair of hydraulic piston-cylinders moving said opposing plates together during injection of the melt for defining said through-hole.

26. A die casting machine according to claim 25, wherein said constricting means further includes means for preventing said plates from moving apart during injection of the melt, said preventing means transmitting a force to said plates along a second line perpendicular to said first line in said cross sectional plane.

27. A die casting machine according to claim 26, wherein said preventing means includes a second pair of hydraulic piston-cylinders for actuating opposing piston rods disposed along said second line and moving said second pair of hydraulic cylinders into contact with side portions of said opposing plates.

28. A die casting machine according to claim 27, wherein said first pair of piston-cylinders are operable to retract after completion of the injection for permitting the upward removal of the solidified melt in the die cavity, the runner hole, and the casting sleeve from the die casting machine.

29. A die casting machine according to claim 28, wherein said cross sectional area of the casting sleeve is 5 to 20 mm greater than the diameter of the through-hole defined by the clamped plates.

* * * * *

UNITED STATES PATENT AND TRADEMARK OFFICE

CERTIFICATE OF CORRECTION

PATENT NO. : 4,799,534

DATED : January 24, 1989

INVENTOR(S) : UENO, DANNOURA and UCHIDA

It is certified that error appears in the above-identified patent and that said Letters Patent is hereby corrected as shown below:

Claim 1, line 16, change "piston-cylindrical" to --piston-cylinder--.

Claim 25, line 4, change "search" to --each--.

Signed and Sealed this

Thirtieth Day of May, 1989

*Attest:*

DONALD J. QUIGG

*Attesting Officer*

*Commissioner of Patents and Trademarks*